US005789710A

United States Patent [19]

Vanderpoel

[11] Patent Number: 5,789,710

[45] Date of Patent: Aug. 4, 1998

[54] REDUCED CROSS-TALK WIRING HARNESS AND METHOD OF ACCOMPLISHING SAME

[75] Inventor: Greg Vanderpoel, Milford, Mass.

[73] Assignee: EMC Corporation, Hopkinton, Mass.

[21] Appl. No.: 294,887

[22] Filed: Aug. 23, 1994

[51] Int. Cl.[6] ..... H01B 11/00

[52] U.S. Cl. ..... 174/72 A; 174/32; 174/34; 333/1; 361/827

[58] Field of Search ..... 174/72 A, 72 TR, 174/268, 32, 33, 34; 361/826, 827; 439/492, 497, 498, 894; 333/1, 4, 5

[56] References Cited

U.S. PATENT DOCUMENTS

| | | | |
|---|---|---|---|
| 4,381,426 | 4/1983 | Cronkite et al. | 174/34 X |
| 4,660,125 | 4/1987 | Purdy et al. | 361/827 X |
| 4,697,051 | 9/1987 | Beggs et al. | 174/34 X |
| 4,829,244 | 5/1989 | Tom et al. | 324/537 |
| 4,831,497 | 5/1989 | Webster et al. | 174/32 X |

*Primary Examiner*—Hyung S. Sough

*Attorney, Agent, or Firm*—Leanne J. Fitzgerald; John M. Gunther, Esq.

[57] ABSTRACT

A reduce cross-talk wiring harness and method for accomplishing same. The wiring harness is used for routing signals from a bus and tag housing to a controller, and for routing signals back from the controller to terminators in the bus and tag housing. The harness includes an input pair and an output pair of bus and tag ribbon cables. The cables in each pair are of essentially the same length. Each pair has a combined bus and tag connector attached to one end, and individual bus and tag connectors attached to the other end. The input and output bus and tag ribbon cables are grouped together for at least part of the distance between the controller and the bus and tag housing in such a manner that at least one of both bus cables or both tag cables are adjacent one another, to reduce cross-talk between the bus cable of one cable pair and the tag cable of the other cable pair.

20 Claims, 4 Drawing Sheets

REDUCED CROSS-TALK WIRING HARNESS AND METHOD OF ACCOMPLISHING SAME

FIELD OF THE INVENTION

This invention relates to a wiring harness for routing signals from a bus and tag housing to and from a controller spaced from that housing.

BACKGROUND OF THE INVENTION

Mainframe computer systems often employ separate massive data storage systems, which requires an enormous number of data signals to flow between the mainframe and the storage system. The mainframe is connected to the data storage system by one or more channels. The data input/output cables in some mainframes manufactured by International Business Machines Corp. (IBM) are called bus and tag cables. Each channel comprises a multiconductor bus cable and a multiconductor tag cable. Because of the timing schemes used to accomplish data transfer, it is critical that the bus and tag wires for each channel be virtually the same length, preferably to at least one part in five hundred.

The storage systems typically include a controller for each channel. The IBM communications scheme requires each cable to be terminated. If the terminators are spaced from the controllers, the storage system cabinet must include multiconductor bus and tag cables running from the cabinet input point to each controller, and from each controller to a terminator. Thus, for each channel there is a requirement of four multiconductor cables in the cabinet. Since cabinet space is at a premium, and since the cabinets include other hardware such as power supplies and the storage devices themselves, the wiring is usually routed along the sides of the cabinet. Because of the presence of so much wiring in a small area, the probability of interfering cross-talk between the bus and tag cables of different channels is high.

One means of simplifying the wiring scheme and minimizing the space required for the wiring is to use flat ribbon cables. Fifty conductor cables are required for each bus and tag leg of each channel. Ribbon cables can be relatively easy routed along the sides of the cabinets by arranging them so that they lay flat, one upon another.

However, since ribbon cables generally provide little to no insulation to electro-magnetic radiation which is typically radiated by high-speed data communication carrying cables and wires, if the bus and tag cables from different channels are adjacent one another, there will be interfering cross-talk between channels, causing data errors, which should be avoided to the extent possible in order to maintain data integrity. Accordingly, these systems require that the wiring be carefully accomplished to avoid laying bus and tag cables from different channels one on top of another over any substantial portion of the length of the cable run between the input housing and the controller housing.

One way to avoid having adjacent bus and tag cables from different channels would be to arrange the connectors in the input housing, as wells as the controller connectors, and the terminator connectors, in such a manner that the tag cable sides or the bus cable sides of adjacent connectors are themselves adjacent. When the wires were then placed between the connectors, either the tag cables or the bus cables of adjacent channels would be side-by-side, thus avoiding cross talk. However, this would require the connectors and cables for each channel to be different, which would increase the complexity of the wiring scheme and so the time required to wire the unit in production, as well as to increase the inventory of connectors and cables which must be kept on hand for repair. Production and inventory costs could be greatly reduced by making all the input connectors the same, all the controller connectors the same, and all the terminator connectors the same, as well as by pre-assembling the cables into bundles which can then be installed in a cabinet.

SUMMARY OF THE INVENTION

It is therefore an object of this invention to provide a reduced cross-talk wiring harness for data storage systems.

It is a further object of this invention to provide such a wiring harness which is easier and quicker to install in production.

It is a further object of this invention to provide such a wiring harness which can be routed along the sides of a system cabinet.

It is a further object of this invention to provide such a wiring harness which uses a minimum of valuable cabinet space.

It is a further object of this invention to provide such a wiring harness which allows users to keep a smaller inventory of spare parts.

This invention results from the realization that a wiring harness for routing signals from a bus and tag housing to a controller spaced from the housing, and back from the controller to terminators in the bus and tag housing, may be accomplished in a manner which uses a minimum of cabinet space and greatly reduces the possibility of cross-talk by using ribbon cables and routing the cables so that, for at least part of the distance between the bus and tag housing and the controller housing, either the bus cables or tag cables for different channels are adjacent.

This invention features a reduced cross-talk wiring harness for routing signals from a bus and tag housing to a spaced controller, and for routing signals back from the controller to terminators in the bus and tag housing. The wiring harness includes an input pair of bus and tag ribbon cables of essentially the same length, with first bus and tag connectors attached to one end of the input bus and tag cables, respectively, for connection to mating signal input connectors in the bus and tag housing. Also included is a first combined bus and tag connector attached to the other end of both of the input bus and tag cables, for connection to a mating controller input connector.

The harness also includes an output pair of bus and tag ribbon cables of essentially the same length, with second bus and tag connectors attached to one end of the output bus and tag cables, respectively, for connection to mating termination connectors in the bus and tag housing, and a second combined bus and tag connector attached to the other end of both of the output bus and tag cables, for connection to a mating controller output connector. The input bus and tag ribbon cables and the output bus and tag ribbon cables are grouped together for at least part of the distance between the controller and the bus and tag housing in such a manner that either both bus cables or both tag cables are adjacent, to reduce cross-talk between the bus cable of one cable pair and the tag cable of the other cable pair.

For a multi-channel system, the wiring harness includes such an input pair of bus and tag ribbon cables and an output pair of bus and tag ribbon cables arranged in the same manner as the one-channel system for each channel. Both pairs of cables for two channels may be routed together in such a manner that either the four tag cables or the four bus cables of both channels are together for at least part of the distance between the controller housing and the bus and tag housing to both reduce cross-talk and make the job of adding the wiring harness to the housing in production of the data storage system easier.

In a more specific embodiment, the wiring harness includes sixteen input pairs of bus and tag ribbon cables, and sixteen output pairs of bus and tag ribbon cables, in which the cables are grouped together in eight groups, each group having eight total input and output bus and tag ribbon cables for two controllers, wherein either the four bus cables or the four tag cables of each group are adjacent to further reduce cross-talk.

The bus and tag housing and the controller housing may be in an upright cabinet having two sides, and these four groups of cables may be found within the cabinet proximate the cabinet sides so that half the wiring runs down each side of the cabinet. The bus and tag ribbon cables of each pair are preferably the same length to approximately one part in five hundred.

Also featured is a method of accomplishing a reduced cross-talk wiring harness for routing signals from a bus and tag housing to a spaced controller, and for routing signals back from the controller to terminators in the bus and tag housing, the method comprising the steps of providing an input pair of bus and tag ribbon cables of essentially the same length, providing first bus and tag connectors attached to one end of the input bus and tag cables, respectively, for connection to mating signal input connectors in the bus and tag housing, and providing a first combined bus and tag connector attached to the other end of both of the input bus and tag cables, for connection to a mating controller input connector.

Further included is the step of providing an output pair of bus and tag ribbon cables of essentially the same length, providing second bus and tag connectors attached to one end of the output bus and tag cables, respectively, for connection to mating termination connectors in the bus and tag housing, and providing a second combined bus and tag connector attached to the other end of both of the output bus and tag cables, for connection to a mating controller output connector. The input bus and tag ribbon cables and the output bus and tag ribbon cables are then grouped together for at least part of the distance between the controller and the bus and tag housing in such a manner that both bus cables or both tag cables are adjacent, to reduce cross-talk between the bus cable of one cable pair and the tag cable of the other cable pair. Further input and output pairs of bus and tag ribbon cables may be provided as well, up to a total of sixteen input pairs of bus and tag ribbon cables and sixteen output pairs of bus and tag ribbon cables.

The method may then accomplish the grouping together of the cables in eight groups, wherein each group has the eight total input and output bus and tag ribbon cables for two controllers, in which either the four bus cables or the four tag cables are arranged adjacent to one another to further reduce cross-talk. In systems in which the bus and tag housing and the controller housing are in an upright cabinet having two sides, four groups of cables may be routed within the cabinet proximate one cabinet side, and the other four groups of cables may be routed within the cabinet proximate the other cabinet side. The ribbon cables of each pair are preferably the same length to approximately one part in five hundred.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
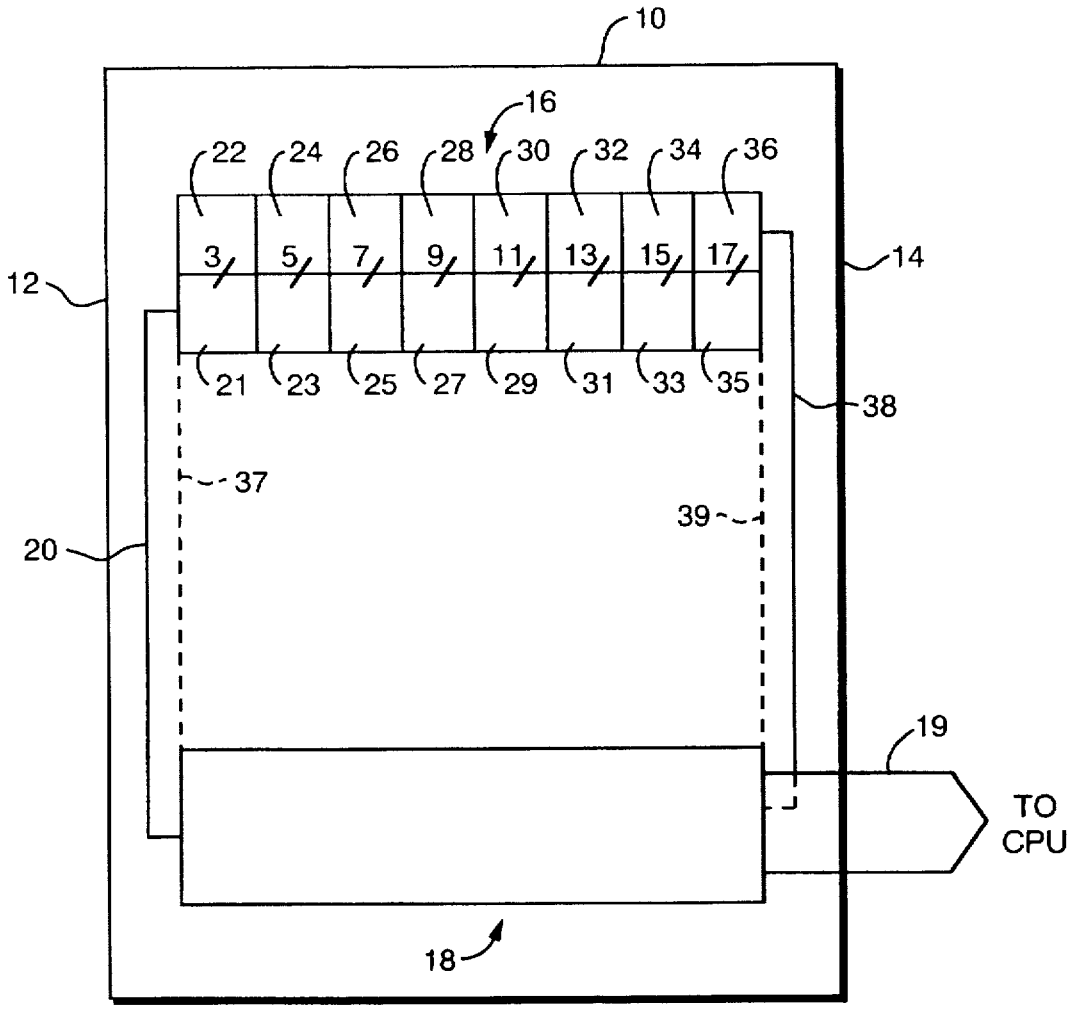
FIG. 1 is a schematic diagram of a housing for a data storage system employing the reduced cross-talk wiring harness of the present invention.

There is shown in FIG. 1 upright cabinet 10 which encloses a data storage system, not shown, for use with a mainframe computer. For IBM mainframes, each input/output channel is carried over a pair of multi-conductor cables called bus and tag cables, represented by arrow 19. Each cable includes at least fifty conductors. These cables are routed to bus and tag housing 18 within cabinet 10 which houses a bus and a tag connector for each channel. Also housed within enclosure 10 is controller housing 16 which houses sixteen controllers 21 through 36 resident on eight printed circuit boards 3 through 17. Each controller is responsive to one I/O channel.

For this system, the cabling requirements are as follows. Bus and tag cables must be run from each input point in housing 18 up to each controller in housing 16. Then, similar bus and tag cables must be run down from each controller in housing 16 to an IBM terminator resident in housing 18. Accordingly, for the sixteen controllers in housing 16 there are required 32 bus and tag cable pairs. Each cable of each cable pair should be the same length to within about one part in five hundred to ensure that the data communications timing scheme is properly accomplished.

Figure 2:
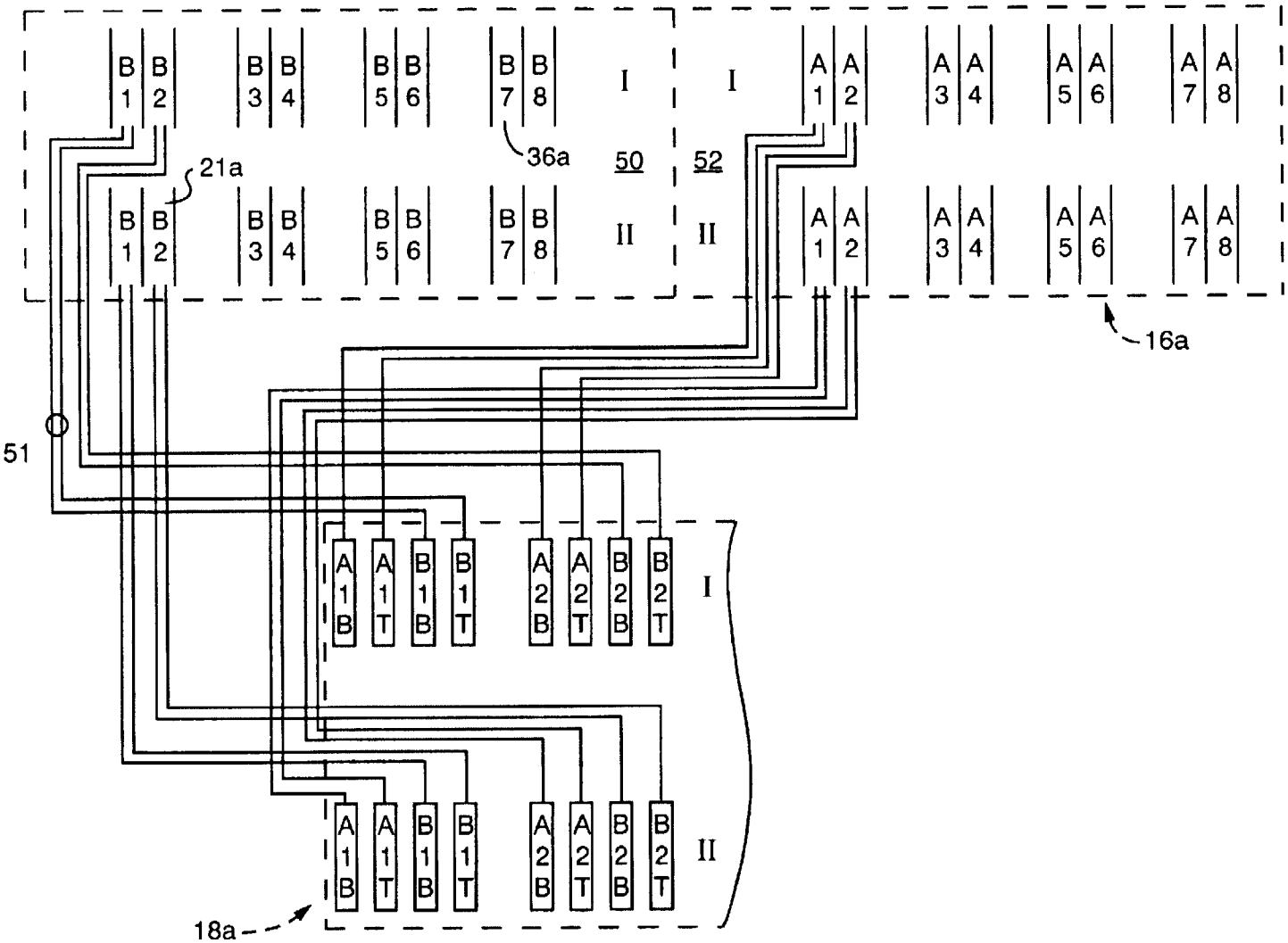
FIG. 2 is a more detailed schematic diagram of the manner in which the wiring of the wiring harness is accomplished in the wiring harness or the system of FIG. 1.

Because space is at a premium in cabinet 10, it is best to route all of the cabling along the sides of the cabinet. In this case, those areas are represented by the space between dashed line 37 and side 12, and the space between dashed line 39 and side 14. Representative of this wiring is cable 20 running from controller 21 to housing 18, and cable 38 running from controller 36 to housing 18. Housing 16 is shown as carrying in the front view of FIG. 1 sixteen connectors each allowing interconnection to a corresponding controller 21 through 36 in housing 16. As shown in FIG. 2, the housing 16 of FIG. 1 also includes sixteen such connectors in the back side of the housing, not shown in FIG. 1, as each controller requires two combined bus and tag connectors, one for the cable pair for routing signals to and from housing 18, and one for the cable pair for routing signals from the controller back to the terminator for the controller, also resident in housing 18.

FIG. 2 shows in detail, part of the wiring which is required to accomplish the system described in conjunction with FIG. 1. Upper controller housing **16*a* includes in its front side 50, sixteen combined bus and tag connectors. Those connectors are labelled B1 through B8 in rows I and II. The connector arrangement in the rear portion 52 is identical except that the connectors are labelled A1 through A8 in rows I and II. One bus and tag cable pair runs from each of the connectors in housing 16***a* to two separate bus and tag connectors in lower bus and tag housing 18*a*. Each of the connectors in housing 18*a* is for a bus or a tag ribbon cable. Accordingly, there are thirty-two combined connectors in controller housing 16*a*, and sixty-four individual connectors in lower bus and tag housing 18*a* (not shown). Cable pair 51 is exemplary of the wiring. It is routed from upper combined bus and tag connector B1 I to lower connectors B1 B (for bus) and B1 T (for tag). As can be seen, upper row I of connectors in housing 18*a* is for upper row I of connectors in housing 16*a*, and lower row II of connectors in lower housing 18*a* is for lower row II of connectors in upper housing 16*a*.

Figure 3:
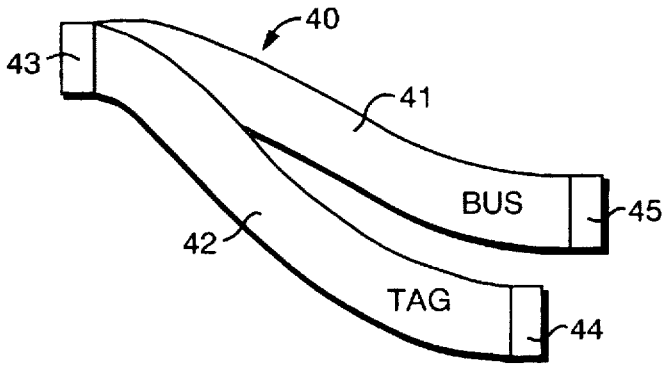
FIG. 3 is a schematic diagram of a single cable for the wiring harness of this invention.

One cable pair 40 is represented in FIG. 3. The cable pair includes fifty conductor ribbon cable 41 for the bus line, and identical fifty conductor ribbon cable 42 for the tag line. Combined bus and tag connector 43 is adapted to fit in a matching connector in controller housing 16*a*. Tag connector 44 and bus connector 45 are adapted to fit in mating connectors in lower housing 18*a*. Cable pair 40 thus leads from the mainframe input point in the cabinet up to a controller, or from a controller back down to the bus and tag housing where the terminator for the channel resides.

Preferably, half of the wiring is routed along each side of the cabinet as shown in FIG. 1. Accordingly, each side of the cabinet must carry sixteen pairs of identical, fifty conductor ribbon cables. This presents an enormous opportunity for cross-talk between bus and tag cables of different cable pairs. Such cross-talk can be extremely damaging to communications since data integrity is comprised. Accordingly such cross-talk is very undesirable in electronic systems, including data storage systems. However, it is critical that the cables of each cable pair be the same length, to at least one part in five hundred, in order to properly accomplish and maintain the communication timing scheme used in IBM mainframe computers or other timing critical systems.

Thus, it is best to route both bus and tag cables of a given cable pair together. In order to use a minimum amount of space, it is also desirable to physically lay the cables one on top of another. It is also desirable to have each of the combined connectors, and each of the bus and tag connectors, be identical, to keep production simple, and inventory requirements minimal. It is unacceptable, however, to lay a tag cable from one cable pair on the bus cable of another cable pair along the entire cable length.

To meet these objectives, and reduce cross-talk, each ribbon cable may be routed so that it is not immediately adjacent to an opposite-type cable of another channel, along as much of the length of the cable as possible. In other words, each bus cable must be adjacent, over at least a good portion of its length, to the tag cable of its cable pair on one side, and a bus cable, not a tag cable, from another cable pair, on its other side. The same holds true for each tag cable, except that on one side it must be adjacent to a tag cable of another cable pair, not a bus cable of another cable pair.

Figure 4B:
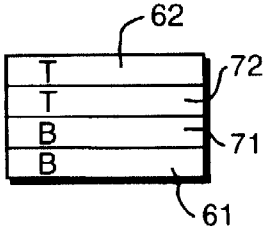
FIG. 4B is a cross-sectional view of the bundled cables of FIG. 4A taken along line A—A.
Figure 5B:
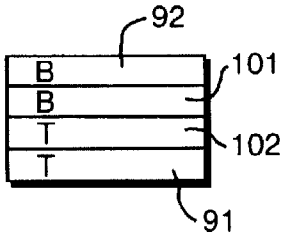
FIG. 5B is a cross-sectional view of the bundled cables of FIG. 5A taken along line B—B.
Figure 4A:
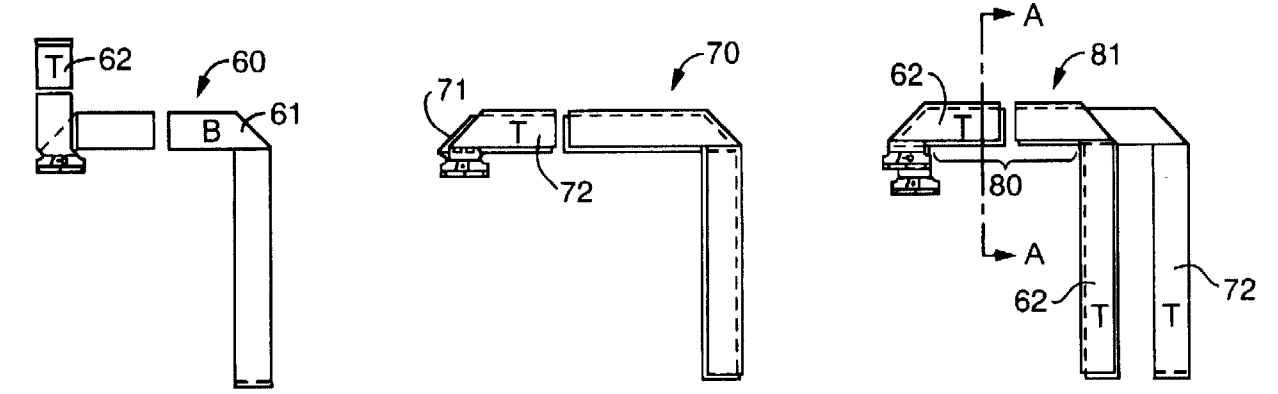
FIG. 4A includes three schematic drawings showing a preferred folding sequence for one cable pair of the wiring harness according to this invention.
Figure 5A:
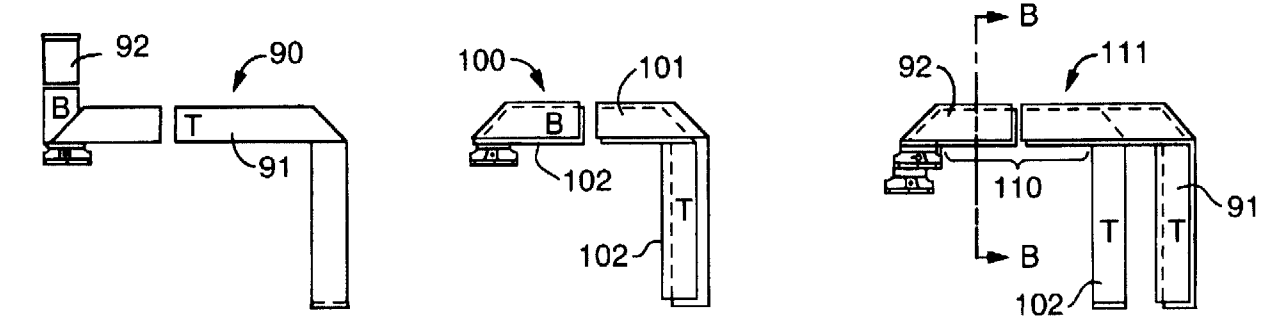
FIG. 5A is a similar sequence for a second cable pair for the wiring harness this invention.
Figure 6:
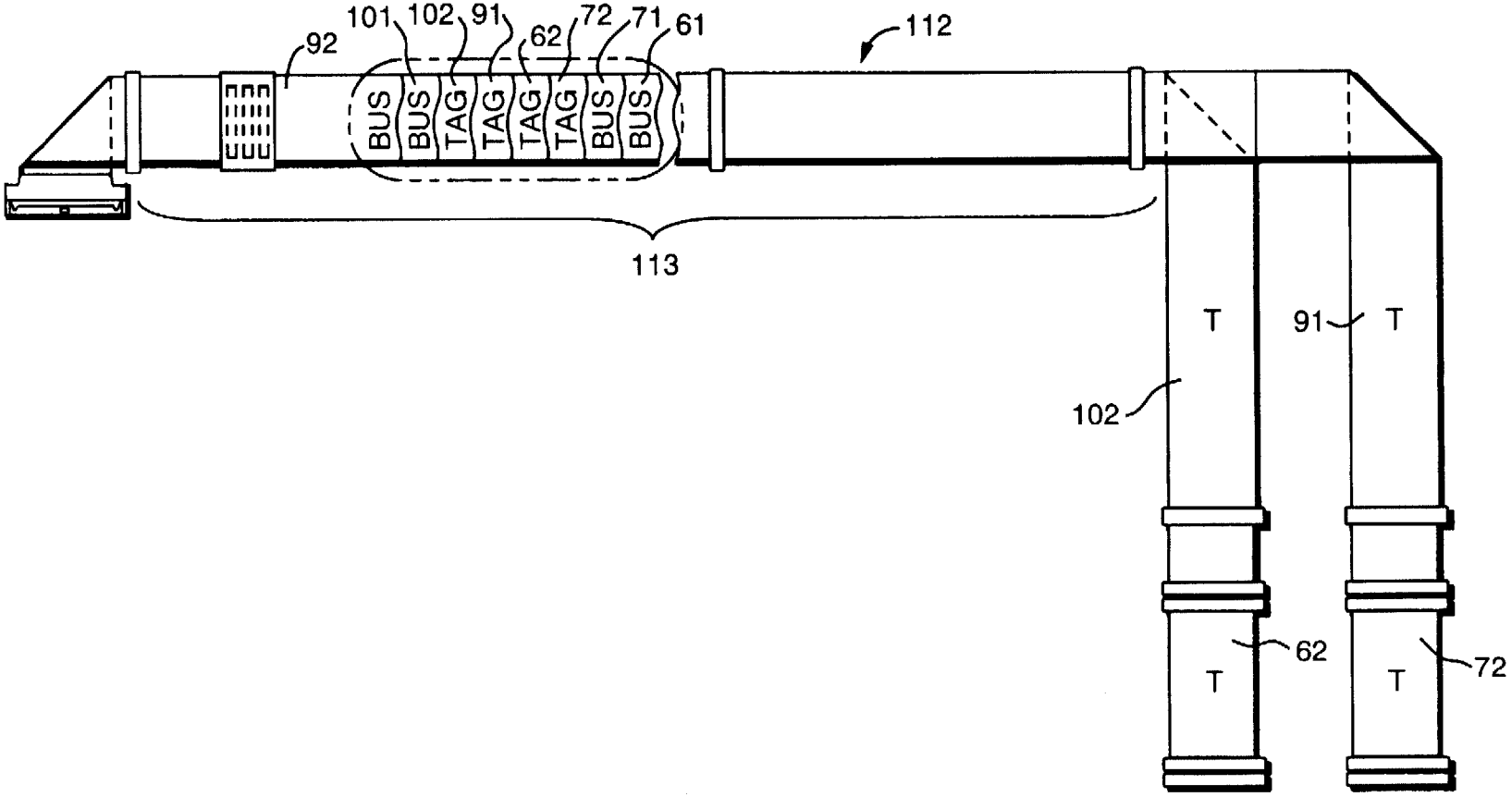
FIG. 6 is a top view of a preassembled multi-cable wiring harness of this invention for accomplishing the wiring for two channels in the system of FIG. 1.

One manner of accomplishing this is detailed in FIGS. 4 through 6. FIG. 4A is a three-view sequence of a manner of folding two cable pairs comprising the input and output pairs from a single controller in the controller cage to make wiring harness 81. FIG. 5A is a similar view for a second two cable pair controller set. In FIG. 4A, cable pairs 60 and 70 together comprise the bus and tag cables running from the bus and tag input terminals in the bus and tag housing, up to a controller in the controller housing, and then back down from that controller to the bus and tag terminators also located in the bus and tag housing.

Cable pair 60 has its bus cable 61 folded as shown, and then cable pair 70 has its tag cable 72 and bus cable 71 folded as shown. Cable pair 70 is then placed directly on top of cable pair 60, so that cable 71 is on cable 61. Cable 62 of cable pair 60 is then folded over the top of cable 72 of cable pair 70 along portion 80 of the combined wiring harness. The harness may be held together using means such as spaced VELCRO brand straps.

The end result is that in portion 80 of the harness, which is the length of the cables which runs along the side of the system housing between the bus and tag housing and the controller housing, the two tag cables 62 and 72, FIG. 4B, of the combined two cable pairs are adjacent, and the two bus cables 71 and 61 are adjacent, as shown in the cross-sectional view of FIG. 4B. The adjacent bus and tag cables 71 and 72, respectively, in the middle of the four cable run are the two cables of cable pair 70. Accordingly, in portion 80 there will be little or no cross-talk between bus and tag cables of different cable pairs.

A second wiring harness 111 comprising two cable pairs is shown being assembled in FIG. 5A. Cable pair 90 includes tag cable 91 and bus cable 92. Tag cable 91 is folded as shown and then bus cable 101 and tag cable 102 of pair 100 is folded as shown. Cable pair 100 is then placed directly on top of cable pair 90 so that cable 102 is on cable 91. Cable 92 is then folded over cable 101 along portion 110 of the assembly to accomplish an assembly in which, in portion 110, the two bus cables 92 and 101, FIG. 5B, are adjacent, and the two tag cables 102 and 91 are adjacent, and the bus and tag cables 101 and 102, respectively, adjacent in the center of the harness are the two cables of cable pair 100. Thus, each of harnesses 81 and 111 accomplishes the input and output cable pairs required for each controller, which over the majority of the length of the distance from the connectors in the bus and tag housing to the connectors in the controller housing do not have any bus ribbon cable adjacent to a tag ribbon cable of another cable pair, or vice versa.

The nested cable pair wiring harnesses of FIGS. 4 and 5 facilitate assembly of the data storage system, as there is just one harness to be installed for each controller. To further simplify assembly, harnesses 81 and 111 can be combined by laying harness 111 on harness 81 to make up two-controller harness 112, as shown in FIG. 6. Since harness 111 has in its bottom half two tag cables, and harness 81 has in its top half two tag cables, the end result, as shown in FIG. 6, is that along length 113 of harness 112 there is no bus cable of one cable pair adjacent to a tag cable of another cable pair, or vice versa. This facilitates all the wiring requirements of two controllers with one wiring harness assembly that greatly reduces the incidence of cross-talk.

Many modifications of the presently disclosed invention will become apparent to those skilled in the art with the benefit of the foregoing description.

What is claimed is:

1. A reduced cross-talk wiring harness for routing signals from a bus and tag housing to a spaced controller, and for routing signals back from the controller to terminators in the bus and tag housing, comprising:

an input pair of cables, each pair comprising a bus ribbon cable and a tag ribbon cable of essentially the same length;

first bus and first tag connectors attached to one end of said input bus and tag cables, respectively;

a first combined bus and tag connector attached to the other end of both of said input bus and tag cables;

an output pair of cables, each pair comprising a bus ribbon cable and a tag ribbon cable of essentially the same length;

second bus and second tag connectors attached to one end of said output bus and tag cables, respectively; and a second combined bus and tag connector attached to the other end of both of said output bus and tag cables;

wherein said input bus and tag ribbon cables and said output bus and tag ribbon cables are grouped together for at least part of a distance between the spaced controller and the bus and tag housing in such a manner that at least one of the bus ribbon cable and the tag ribbon cable of the input pair of bus and tag ribbon cables is adjacent a respective and corresponding at least one of the bus ribbon cable and the tag ribbon cable of the output pair of bus and tag ribbon cables.

2. The reduced cross-talk wiring harness of claim 1 further including:

a second input pair of bus and tag ribbon cables of essentially the same length;

third bus and third tag connectors attached to one end of said input bus and tag cables, respectively, of said second input pair of bus and tag ribbon cables, for connection to mating signal input connectors in the bus and tag housing;

a third combined bus and tag connector attached to the other end of both of said input bus and tag cables of said second input pair, for connection to a mating controller input connector;

a second output pair of bus and tag ribbon cables of essentially the same length;

fourth bus and fourth tag connectors attached to one end of said output bus and tag cables, respectively, of said second output pair of bus and tag ribbon cables, for connection to mating terminator connectors in the bus and tag housing; and a fourth combined bus and tag connector attached to the other end of both of said output bus and tag cables of said second output pair, for connection to a mating controller output connector;

wherein said first and second input pairs of bus and tag ribbon cables and said first and second output pairs of bus and tag ribbon cables are grouped together for at least part of a distance between the spaced controller and the bus and tag housing in such a manner that either all four bus cables or all four tag cables are adjacent, to reduce cross-talk between the bus cable of one cable pair and the tag cable of another cable pair.

3. The reduced cross-talk wiring harness of claim 2 in which said wiring harness includes sixteen input pairs of bus and tag ribbon cables, and sixteen output pairs of bus and tag ribbon cables, wherein said cables are grouped together in eight groups, each group having a total of eight input and output bus and tag ribbon cables for two controllers, wherein either the four bus cables or the four tag cables of each group are adjacent within the group to further reduce cross-talk.

4. The reduced cross-talk wiring harness of claim 3 in which the bus and tag housing and the controller are in an upright cabinet having two sides, and four groups of cables are within the cabinet and proximate one cabinet side, and four groups of cables are within the cabinet and proximate the other cabinet side.

5. The reduced cross-talk wiring harness of claim 1 in which the input pair of bus and tag ribbon cables are the same length to approximately 1 part in 500.

6. The reduced cross-talk wiring harness of claim 1 in which the output pair of bus and tag ribbon cables are the same length to approximately 1 part in 500.

7. A method of accomplishing a reduced cross-talk wiring harness for routing signals from a bus and tag housing to a spaced controller, and for routing signals back from the controller to terminators in the bus and tag housing, comprising the steps of:

providing an input pair of bus and tag ribbon cables of essentially the same length;

attaching first bus and tag connectors to one end of said input bus and tag cables, respectively, for connection to mating signal input connectors in the bus and tag housing;

attaching a first combined bus and tag connector to the other end of both of said input bus and tag cables, for connection to a mating controller input connector;

providing an output pair of bus and tag ribbon cables of essentially the same length;

attaching second bus and tag connectors to one end of said output bus and tag cables, respectively, for connection to mating terminator connectors in the bus and tag housing;

attaching a second combined bus and tag connector to the other end of both of said output bus and tag cables, for connection to a mating controller output connector; and grouping said input bus and tag ribbon cables and said output bus and tag ribbon cables together for at least part of the distance between the controller and the bus and tag housing in such a manner that either both bus cables or both tag cables are adjacent, to reduce cross-talk between the bus cable of one cable pair and the tag cable of the other cable pair.

8. The method of accomplishing a reduced cross-talk wiring harness of claim 7 further comprising the steps of:

providing a second input pair of bus and tag ribbon cables of essentially the same length;

attaching third bus and tag connectors attached to one end of said input bus and tag cables, respectively, of said second input pair to mating signal input connectors in the bus and tag housing;

attaching a third combined bus and tag connector to the other end of both of said input bus and tag cables, of said second input pair for connection to a mating controller input connector;

providing a second output pair of bus and tag ribbon cables of essentially the same length;

attaching fourth bus and tag connectors to one end of said output bus and tag cables, respectively, of said second output pair for connection to mating terminator connectors in the bus and tag housing;

attaching a fourth combined bus and tag connector to the other end of both of said output bus and tag cables, of said second output pair for connection to a mating controller output connector; and grouping said input bus and tag ribbon cables and said output bus and tag ribbon cables together for at least part of the distance between the controller and the bus and tag housing in such a manner that either both bus cables or both tag cables are adjacent, to reduce cross-talk between the bus cable of one cable pair and the tag cable of the other cable pair.

9. The method of accomplishing a reduced cross-talk wiring harness of claim 8 in which said wiring harness includes sixteen input pairs of bus and tag ribbon cables, and sixteen output pairs of bus and tag ribbon cables, further including the step of grouping said cables together in eight groups, each group having the eight total input and output bus and tag ribbon cables for two controllers, wherein either the four bus cables or the four tag cables of each group are adjacent within the group to further reduce cross-talk.

10. The method of accomplishing a reduced cross-talk wiring harness of claim 9 in which the bus and tag housing and the controller are in an upright cabinet having two sides, including the further steps of routing four groups of cables within the cabinet and proximate one cabinet side, and routing four groups of cables within the cabinet and proximate the other cabinet side.

11. The method of accomplishing a reduced cross-talk wiring harness of claim 7 in which the input pair of bus and tag ribbon cables are the same length to approximately 1 part in 500.

12. The method of accomplishing a reduced cross-talk wiring harness of claim 7 in which the output pair of bus and tag ribbon cables are the same length to approximately 1 part in 500.

13. A reduced cross-talk wiring harness having first and second ends, comprising:

at least one first pair of data cables, each said first pair of data cables having at least first and second data type cables;

at least one second pair of data cables, each said second pair of data cables having said at least first and second data type cables; and wherein said at least one first pair of data cables and said at least one second pair of data cables are disposed adjacent for at least portion of a distance between the first and second ends of said wiring harness such that said first data type cable of said at least one first pair of data cables is disposed adjacent said first data type cable of said at least one second pair of data cables, for reducing cross-talk between said first pair of data cables and said second pair of data cables.

14. The reduced cross-talk wiring harness of claim 13, wherein said at least one first and second pair of data cables include ribbon cables.

15. The reduced cross-talk wiring harness of claim 14, wherein said first data type cable includes a bus data cable and said second data type cable includes a data tag cable.

16. The reduced cross talk wiring harness of claim 14, wherein said first data type cable includes a data tag type cable and said second data type cable includes a data bus type cable.

17. The reduced cross-talk harness of claim 13, wherein said at least one first pair of data cables includes a plurality of pairs of data cables, and said at least one second pair of data cables includes a plurality of pairs of data cables, and wherein said first data type cable of each of said plurality of first pairs of data cables is disposed adjacent said first data type cable of each of said plurality of second pairs of data cables.

18. A method of providing a reduced cross-talk wiring harness having first and second ends, said method comprising the steps of:

providing at least one first pair of data cables, each said first pair of data cables having at least first and second data type cables;

providing at least one second pair of data cables, each said second pair of data cables having at least first and second data type cables;

adjacently disposing said at least one first pair of data cables and said at least one second pair of data cables for at least a portion of a distance between said first and second ends of said wiring harness such that said first data type cable of said at least one first pair of data cables is adjacent said first data type cable of said at least one second pair of data cables, to reduce cross-talk between said at least one first pair of data cables and said at least one second pair of data cables.

19. The method of claim 18, wherein said first data type cables includes a data bus cable and said second data type cables includes a data tag cable, and wherein the step of adjacently disposing said at least one first pair of data cables and said at least one second pair of data cables includes adjacently disposing said bus cables of said at least one first and second pair of data cables.

20. The method of claim 18, wherein said first data type cables includes a data bus cable and said second data type cables includes a data tag cable, and wherein the step of adjacently disposing said at least one first pair of data cables and said at least one second pair of data cables includes adjacently disposing said tag cables of said at least one first and second pair of data cables.

* * * * *